US008517569B2

(12) United States Patent
Chen et al.

(10) Patent No.: US 8,517,569 B2
(45) Date of Patent: Aug. 27, 2013

(54) ILLUMINATION DEVICE

(75) Inventors: Bishou Chen, Shanghai (CN); Yinghua Wang, Shanghai (CN); Ming Chen, Shanghai (CN); Sheng Li, Shanghai (CN)

(73) Assignees: Shanghai Sansi Electronics Engineering Co., Ltd., Shanghai (CN); Shanghai Sansi Technology Co., Ltd., Shanghai (CN); Jiashan Jinghui Photoelectricty Technology co., Ltd., Jiaxing, Zhejiang Province (CN)

( * ) Notice: Subject to any disclaimer, the term of this patent is extended or adjusted under 35 U.S.C. 154(b) by 169 days.

(21) Appl. No.: 13/227,152

(22) Filed: Sep. 7, 2011

(65) Prior Publication Data

US 2012/0307491 A1 Dec. 6, 2012

(30) Foreign Application Priority Data

Jun. 3, 2011 (CN) ..... 2011 1 0148416

(51) Int. Cl.
*F21V 29/00* (2006.01)

(52) U.S. Cl.
USPC ..... 362/294; 362/373; 362/249.02; 362/545; 362/547; 257/712

(58) Field of Classification Search
USPC ..... 362/294, 545, 547, 373, 249.02; 313/498; 257/712
See application file for complete search history.

(56) References Cited

U.S. PATENT DOCUMENTS

| | | | | |
|---|---|---|---|---|
| 4,774,632 | A * | 9/1988 | Neugebauer | 361/715 |
| 6,541,800 | B2 * | 4/2003 | Barnett et al. | 257/98 |
| 6,964,499 | B2 * | 11/2005 | Colip et al. | 362/244 |
| 7,040,790 | B2 * | 5/2006 | Lodhie et al. | 362/541 |
| 7,198,386 | B2 * | 4/2007 | Zampini et al. | 362/294 |
| 7,498,610 | B2 * | 3/2009 | Kim et al. | 257/99 |
| 7,723,747 | B2 * | 5/2010 | Koo et al. | 257/100 |
| 7,808,004 | B2 * | 10/2010 | Sun et al. | 257/79 |
| 8,129,744 | B2 * | 3/2012 | Koo et al. | 257/100 |
| 8,279,608 | B2 * | 10/2012 | Chen | 361/719 |
| 2006/0203510 | A1 * | 9/2006 | Noh et al. | 362/580 |
| 2009/0194868 | A1 * | 8/2009 | Chong et al. | 257/712 |
| 2012/0020077 | A1 * | 1/2012 | Chang | 362/235 |
| 2012/0020108 | A1 * | 1/2012 | Chang | 362/555 |

* cited by examiner

*Primary Examiner* — Ali Alavi

(57) ABSTRACT

An illumination device includes a first heat dissipation structure which includes at least a first heat dissipation unit including a first heat dissipation member and a second heat dissipation member which have conductivity and are insulated from each other, a second heat dissipation structure insulated from the first heat dissipation structure and connected with the first heat dissipation structure as a whole, at least a light-emitting device attached on an end surface of the first heat dissipation structure and electrically connected with the first heat dissipation structure, and an active circuit connector provided at a lower portion of the illumination device for connecting with an external power supply, wherein a number of the first heat dissipation structure is equal to a number of the light-emitting device. The illumination device of the present invention can effectively improve the heat dissipation efficiency, and have the simple structure and low cost.

20 Claims, 7 Drawing Sheets

ILLUMINATION DEVICE

BACKGROUND OF THE PRESENT INVENTION

1. Field of Invention

The present invention relates to a lighting field, and more particularly to an illumination device which is capable of highly effectively dissipating heat.

2. Description of Related Arts

The heat dissipation is an important problem for the illuminating lamp to affect the service life thereof. Especially nowadays, LEDs have replaced the traditional light sources as the lighting sources, it is very important to solve the heat dissipation due to the small size and concentrated heat of LEDs.

In the existing illuminating lamps, the luminescent devices such as LEDs are mostly welded on a printed circuit board (PCB), and then the PCB is fastened to a heat dissipation structure by a heat-conducting gel. The heat generated by the LEDs while working is transferred to the heat dissipation structure by the PCB and thermal-conductivity materials for dissipating heat. The PCB and the heat-conducting gel between the LED and the heat dissipation structure increase the thermal resistance of the heat transfer process, thereby reducing the effect of heat dissipation.

SUMMARY OF THE PRESENT INVENTION

An object of the present invention is to provide an illumination device which is capable of effectively improving the efficiency of heat dissipation, and has the simple structure and low cost.

Accordingly, in order to accomplish the above object, the present invention provides an illumination device comprising:

a first heat dissipation structure comprising at least a first heat dissipation unit comprising a first heat dissipation member and a second heat dissipation member which have conductivity and are insulated from each other;

a second heat dissipation structure insulated from the first heat dissipation structure and connected with the first heat dissipation structure as a whole;

at least a light-emitting device attached on an end surface of the first heat dissipation unit and electrically connected with the first heat dissipation unit; and an active circuit connector provided at a lower portion of the illumination device for connecting with an external power supply, wherein a number of the first heat dissipation unit is equal to a number of the light-emitting device.

Preferably, the first heat dissipation member is fastened with the second heat dissipation member of the first heat dissipation unit of the first heat dissipation structure by a non-conductive ring.

Preferably, the second heat dissipation structure is provided at a peripheral edge of the first heat dissipation structure.

Preferably, the first and second heat dissipation structures are made of metal materials with high thermal conductivity, and are insulated from each other by non-metallic materials with high thermal conductivity.

Preferably, the first heat dissipation structure is made of metal materials with high thermal conductivity, and the second heat dissipation structure is made of non-metallic materials with high thermal conductivity.

Preferably, the first heat dissipation structure is made of copper.

Preferably, a plurality of holes are provided at sidewalls of the first heat dissipation structure.

Preferably, the first heat dissipation units of the first heat dissipation structure are connected with each other in series by a circuit connecting board.

Preferably, the first heat dissipation units of the first heat dissipation structure are connected with each other in series by a conductive material.

Preferably, the conductive material, the first heat dissipation member of a first heat dissipation unit of the first heat dissipation structure, and the second heat dissipation member of an adjacent first heat dissipation unit of the first heat dissipation structure are connected with each other in series and made as a whole.

Preferably, the second heat dissipation structure has a hollow-out structure which is capable of dissipating heat by air convection.

Preferably, the light-emitting device is an LED chip.

Preferably, the light-emitting device is an LED packaging body.

Preferably, a lamp housing or an optical lens is provided outside of the light-emitting device.

Preferably, a heat sink and a first electrode pin of the light-emitting device are connected to an end surface of the first heat dissipation member of the first heat dissipation unit of the first heat dissipation structure, a second electrode pin of the light-emitting device is connected to an end surface of the second heat dissipation member of the first heat dissipation unit of the first heat dissipation structure, wherein a surface area of the end surface of the first heat dissipation member is larger than that of the end surface of the second heat dissipation member.

Preferably, the active circuit connector can be an electrode lead, screw thread, bayonet or push-in spring.

The beneficial effects of the present invention are described as follows. The illumination device of the present invention adopts two layers of heat dissipation structures, wherein a layer of heat dissipation structure has the dual functions of conductance and heat dissipation. The luminous devices are directly attached to the layer of heat dissipation structure without the intermediate PCB structure, so that the heat generated by the luminous devices is directly transferred to the heat dissipation structure to reducing the thermal resistance of the heat dissipation path, thereby greatly improving the efficiency of heat dissipation. According to the power needed by the illumination device and different chosen luminous devices, the layer of heat dissipation structure with the conductivity function is divided into several parts and the several parts are connected with each other in series for ensuring the normal operation and excellent heat dissipation of the lamp. The two layers of heat dissipation structures are insulated from each other and tightly connected with each other to be a whole, thereby further improving the efficiency of heat dissipation of the illumination device.

These and other objectives, features, and advantages of the present invention will become apparent from the following detailed description, the accompanying drawings, and the appended claims.

DETAILED DESCRIPTION OF THE PREFERRED EMBODIMENT

Figure 1:
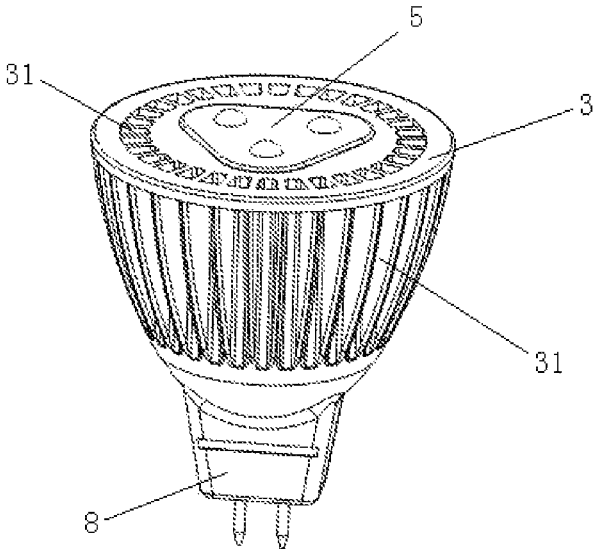
FIG. 1 is a perspective view of an illumination device according to a first preferred embodiment of the present invention.
Figure 2:
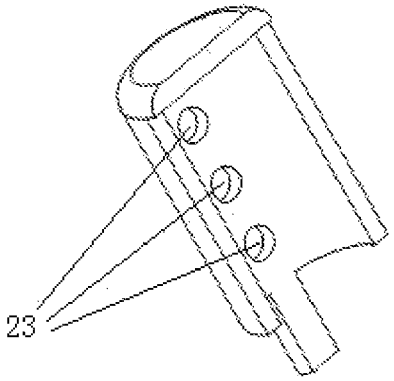
FIG. 2 is a perspective view of a part of a first heat dissipation unit of a first heat dissipation structure of the illumination device according to the first preferred embodiment of the present invention.
Figure 3:
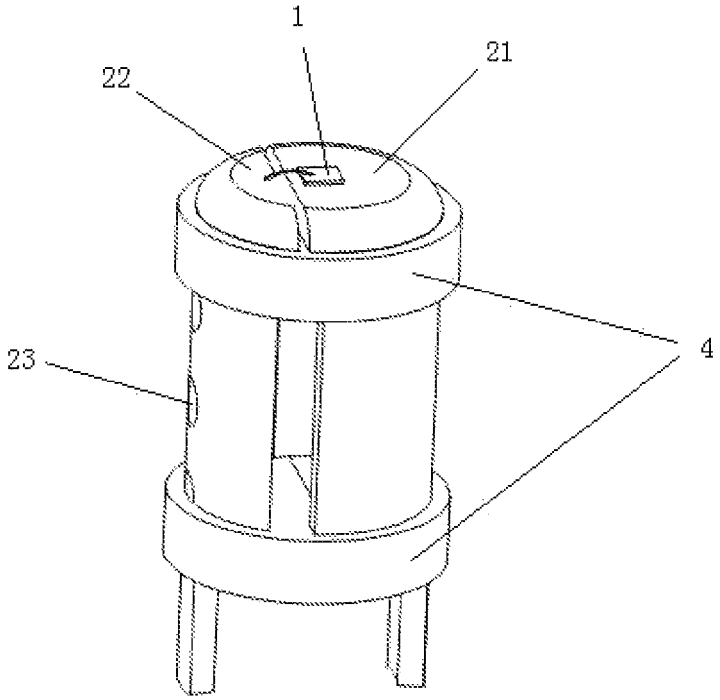
FIG. 3 shows that the LED chip is attached to the end surface of the first heat dissipation unit of the first heat dissipation structure of the illumination device according to the first preferred embodiment of the present invention.

Referring to FIGS. 1 to 7 of the drawings, an illumination device according to a first preferred embodiment of the present invention is illustrated, wherein the illumination device comprises three LED chips 1 as the luminescent devices, a first heat dissipation structure 2 and a second heat-dissipation structure 3. The heat sink is connected with the negative electrode within the LED chips 1. The first heat-dissipation structure 2, made of metal copper with high heat conductivity, consists of three first heat-dissipation units. Every first heat-dissipation unit comprises two parts 21 and 22 which are insulated from each other and fastened with each other by a nonmetallic lantern ring 4 so as to avoid the dislocation and movement between the two parts in the production process. The second heat dissipation structure 3 is made of non-metallic materials with high heat conductivity. The heat sink and the negative electrode pin of each of the LED chips 1 are welded on the end face of a part 21 of a first heat dissipation unit of the first heat dissipation structure 2. The positive electrode pin of each of the LED chips 1 is welded on the end face of another part 22 of the first heat dissipation unit of the first heat-dissipation structure 2. The heat dissipated by the LED chips 1 is mostly transferred to the heat dissipation structure by the heat sink at the bottom of the LED chips 1, so the surface area of the part 21 for welding the heat sink and the negative electrode pin of the LED chips 1 is larger than that of the part 22 for welding the positive electrode pin of the LED chips 1 to effectively dissipate heat, as shown in FIG. 3.

It is worth to mention that in the two parts of every first heat-dissipation unit of the first heat-dissipation structure 2, the surface area of the part for attaching the heat sink and one of the positive and negative electrode pins of the LED chips 1 is larger than that of the part for attaching the other of the positive and negative electrode pins of the LED chips 1 to effectively dissipate heat. Furthermore, the heat sink can be connected with the positive electrode pin or the negative electrode pin of the LED chips 1.

Figure 4:
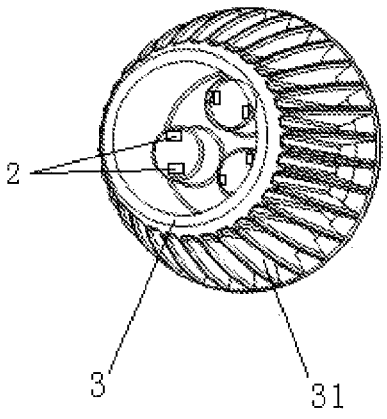
FIG. 4 illustrates the position relationship between the first heat dissipation structure and the second heat dissipation structure of the illumination device according to the first preferred embodiment of the present invention.
Figure 5:
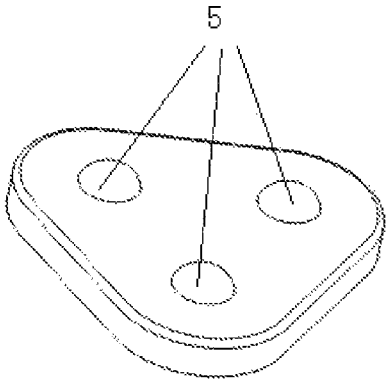
FIG. 5 is a perspective view of a lens of the illumination device according to the first preferred embodiment of the present invention.
Figure 6:
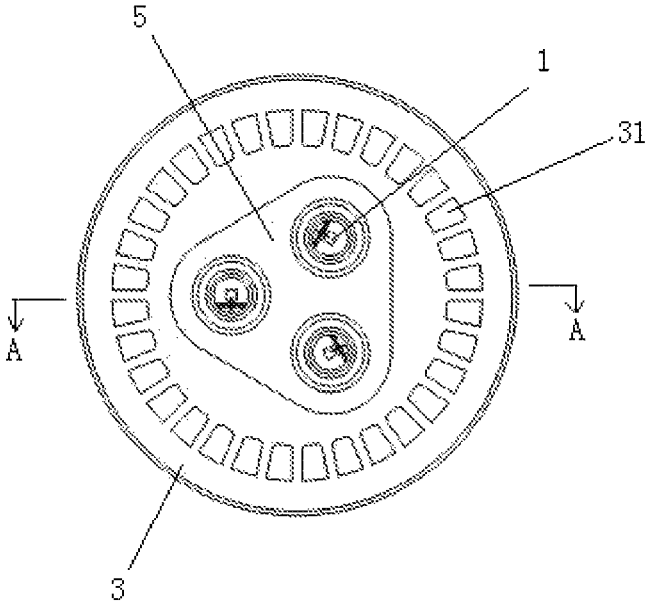
FIG. 6 is a front view of the illumination device shown in FIG. 1.

Referring to FIG. 4, the second heat dissipation structure 3 is provided at the peripheral edge of the first heat dissipation structure 2 for tightly wrapping the first heat dissipation structure 2, so as to ensure that the heat of the first heat dissipation structure 2 can be directly transferred to the second heat dissipation structure 3 and emitted as possible. Simultaneously, a plurality of hollow-out structures 31 are provided at the second heat dissipation structure 3 for effectively dissipating the heat by air convection to further improve the heat dissipation efficiency.

As shown in FIG. 2, a plurality of holes 23 are provided at the sidewalls of the first heat dissipation structure 2 for tightly fastening the first heat dissipation structure 2 and the second heat dissipation structure 3 to be a whole so as to effectively dissipate the heat. In the production process, the second heat dissipation structure 3 is manufactured by injecting the non-metallic thermal-conductive materials into the mold, so that the nonmetallic thermal-conductive materials can enter into the first heat dissipation structure 2 by the holes 23, thereby the first heat dissipation structure 2 and the second heat dissipation structure 3 are tightly fastened to be a whole.

Figure 7:
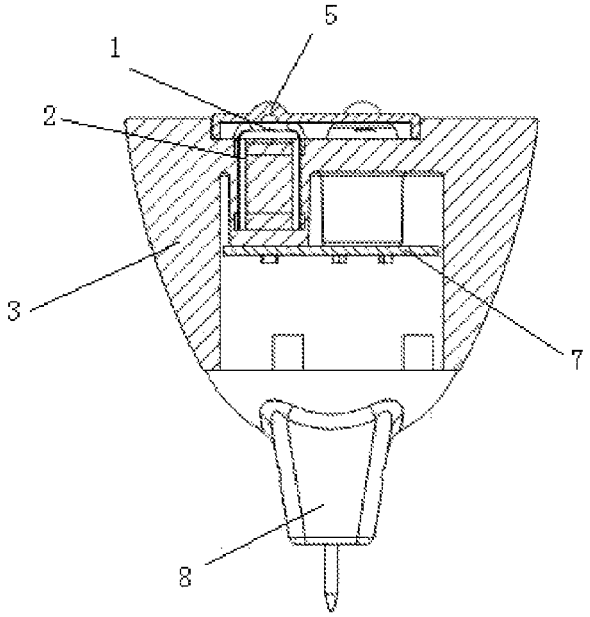
FIG. 7 is a sectional view of the illumination device along the A-A direction shown in FIG. 1.
Figure 8:
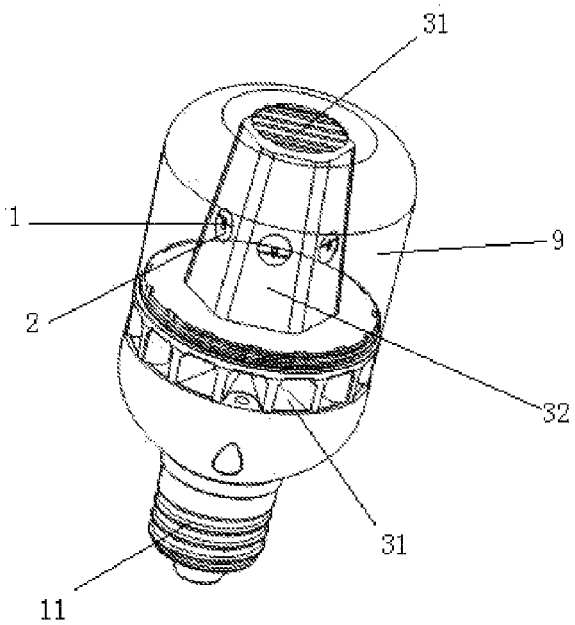
FIG. 8 is a perspective view of an illumination device according to a second preferred embodiment of the present invention.
Figure 9:
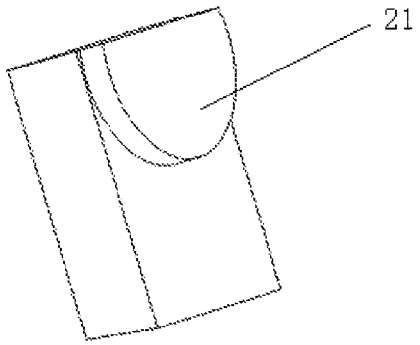
FIG. 9 is a perspective view of a part of a first heat dissipation unit of a first heat dissipation structure of the illumination device according to the second preferred embodiment of the present invention.
Figure 10:
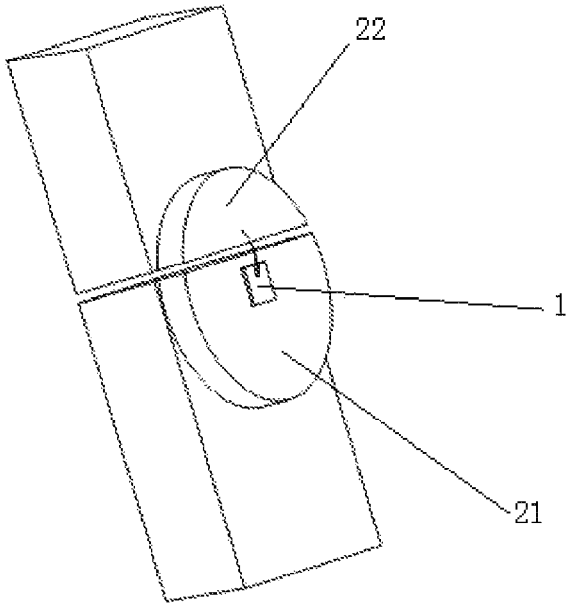
FIG. 10 is a perspective view showing that the LED chip is attached to the end surface of the first heat dissipation unit of the first heat dissipation structure of the illumination device according to the second preferred embodiment of the present invention.

As shown in the sectional view of FIG. 7, a one-piece lens 5 is mounted at the light-emitting surface of the illumination device. A circuit connecting board 7 is installed within the second heat dissipation structure 3 for connecting the three first heat dissipation units of the first heat dissipation structure 2 with each other in series. The positive and negative electrode leads are led from the circuit connecting board 7. The illumination device is connected with the external power supply by an electrode plug 8 provided at the bottom of the circuit connecting board 7 for ensuring the normal operation.

Figure 11:
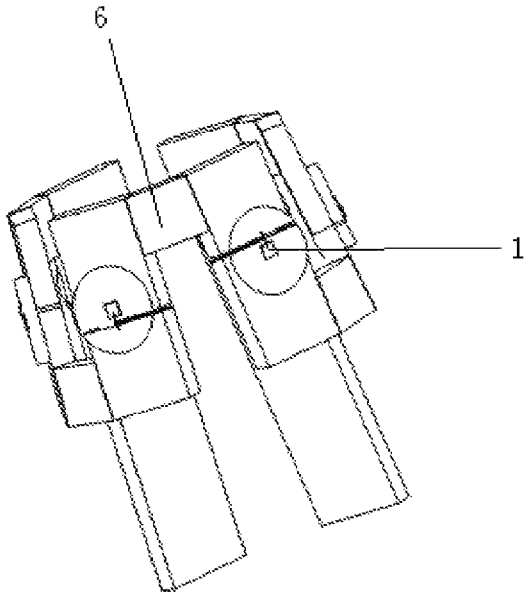
FIG. 11 is a perspective view of a plurality of first heat dissipation units of the first heat dissipation structure connected with each other in series of the illumination device shown in FIG. 8.
Figure 12:
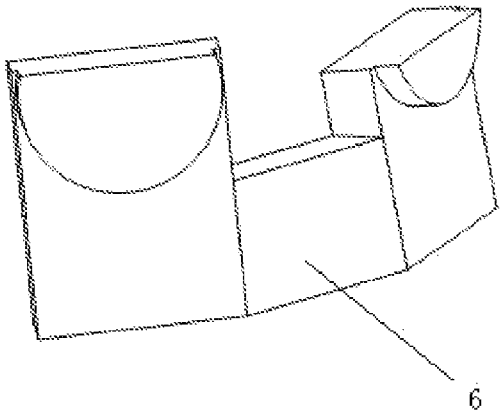
FIG. 12 shows that a part of a first heat dissipation unit is connected with another part of an adjacent first heat dissipation unit in series to be a whole.
Figure 13:
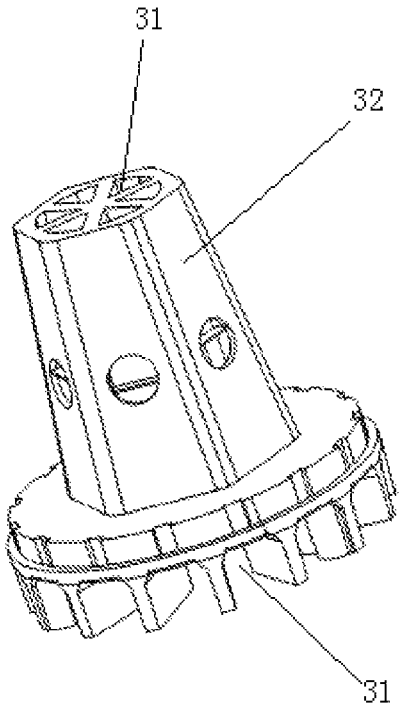
FIG. 13 is a perspective view of the second heat dissipation structure of the illumination device shown in FIG. 8.
Figure 14:
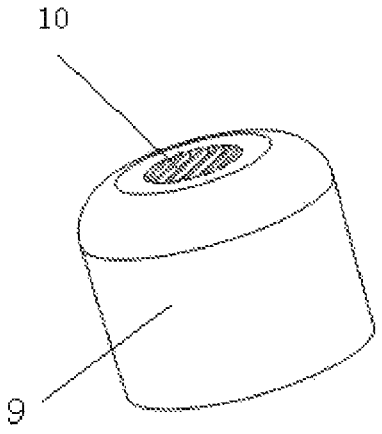
FIG. 14 is a perspective view of a lamp housing of the illumination device shown in FIG. 8.

Referring to FIGS. 8 to 14 of the drawings, an illumination device according to a second preferred embodiment of the present invention is illustrated. The first heat dissipation structure 2 is made of copper with high thermal-conductivity, and the second heat dissipation structure 3 is made of non-metallic materials with high thermal-conductivity. N LED chips 1 as the luminescent devices are respectively welded on the N end surfaces of the first heat dissipation structure 2. The N end surfaces of the first heat dissipation structure 2 are respectively distributed at the surrounding sidewalls of the chimney-shaped structure 32 of the second heat dissipation structure 3, so that the light-emitting surfaces of the LED chips 1 face towards the surrounding area in the second preferred embodiment of the present invention. The N first heat dissipation units of the first heat dissipation structure 2 are connected with each other in series by (N−1) metal coppers 6. As shown in FIG. 12, each of the metal coppers 6, a part of a first heat dissipation unit of the first heat dissipation structure connected with one of the metal coppers 6 in series, another part of an adjacent first heat dissipation unit of the first heat dissipation structure connected with one of the metal copper 6 in series are made wholly. The N first heat dissipation units of the first heat dissipation structure 2 are connected with each other in series by N−1 wholly-made modules, as shown in FIG. 11. The second heat dissipation structure 3 comprises a chimney-shaped structure 32 which wraps the first heat dissipation structure 2. A transparent lamp housing 9 is covered the chimney-shaped structure 32. A plurality of holes 10 are provided at the top of the lamp housing 9. The second heat dissipation structure 3 has a plurality of hollow structures 31. In the second preferred embodiment of the present invention, the illumination device comprises a threaded coupling 11 at the bottom thereof for connecting the illumination device with the external power supply.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An illumination device, comprising:

a first heat dissipation structure comprising at least a first heat dissipation unit comprising a first heat dissipation member and a second heat dissipation member which have conductivity and are insulated from each other;

a second heat dissipation structure insulated from said first heat dissipation structure and connected with said first heat dissipation structure as a whole;

at least a light-emitting device attached on an end surface of said first heat dissipation unit of said first heat dissipation structure and electrically connected with said first heat dissipation unit; and an active circuit connector provided at a lower portion of said illumination device for connecting with an external power supply, wherein a number of said first heat dissipation unit is equal to a number of said light-emitting device.

2. The illumination device, as recited in claim 1, wherein said first heat dissipation structure comprises at least two first heat dissipation units connected with each other in series.

3. The illumination device, as recited in claim 1, wherein said second heat dissipation structure is provided at a peripheral edge of said first heat dissipation structure for tightly wrapping said first heat dissipation structure.

4. The illumination device, as recited in claim 3, further comprising at least a non-conductive ring, wherein said first heat dissipation member and said second heat dissipation member of said first heat dissipation unit of said first heat dissipation structure are fastened with each other by said non-conductive ring.

5. The illumination device, as recited in claim 3, wherein said first and second heat dissipation structures are made of metal materials with high thermal conductivity, and are insulated from each other by non-metallic materials with high thermal conductivity.

6. The illumination device, as recited in claim 3, wherein said first heat dissipation structure is made of metal materials with high thermal conductivity, and said second heat dissipation structure is made of non-metallic materials with high thermal conductivity.

7. The illumination device, as recited in claim 6, wherein said first heat dissipation structure is made of copper.

8. The illumination device, as recited in claim 4, a plurality of holes are provided at sidewalls of said first heat dissipation structure for tightly fastening said first heat dissipation structure and said second heat dissipation structure to be a whole so as to effectively dissipate heat.

9. The illumination device, as recited in claim 2, further comprising a circuit connecting board, wherein said first heat dissipation units of said first heat dissipation structure are connected with each other by said circuit connecting board.

10. The illumination device, as recited in claim 2, further comprising a conductive material, wherein said first heat dissipation units of said first heat dissipation structure are connected with each other by said conductive material.

11. The illumination device, as recited in claim 10, wherein said conductive material, a first heat dissipation member of a first heat dissipation unit of said first heat dissipation structure connected with said conductive material, and a second heat dissipation member of an adjacent first heat dissipation unit of said first heat dissipation structure connected with said conductive material are made as a whole.

12. The illumination device, as recited in claim 3, wherein said light-emitting device, having a first electrode pin and a second electrode pin, comprises a heat sink, wherein said heat sink and said first electrode pin are welded to an end surface of said first heat dissipation member of said first heat dissipation unit, and said second electrode pin is connected to an end surface of said second heat dissipation member of said first heat dissipation unit, wherein a surface area of said end surface of said first heat dissipation member is larger than that of said end surface of said second heat dissipation member.

13. The illumination device, as recited in claim 1, wherein said second heat dissipation structure has a hollow-out structure for effectively dissipating heat by air convection.

14. The illumination device, as recited in claim 13, wherein said second heat dissipation structure comprises a hollow-out member and a chimney-shaped member provided on said hollow-out member, wherein an end surface of said first heat dissipation structure is provided at a sidewall of said chimney-shaped member such that said chimney-shaped member enwraps said first heat dissipation structure.

15. The illumination device, as recited in claim 11, wherein said second heat dissipation structure comprises a hollow-out member and a chimney-shaped member provided on said hollow-out member, wherein an end surface of said first heat dissipation structure is provided at a sidewall of said chimney-shaped member such that said chimney-shaped member enwraps said first heat dissipation structure.

16. The illumination device, as recited in claim 14, wherein said light-emitting device, having a first electrode pin and a second electrode pin, comprises a heat sink, wherein said heat sink and said first electrode pin are welded to an end surface of said first heat dissipation member of said first heat dissipation unit, and said second electrode pin is connected to an end surface of said second heat dissipation member of said first heat dissipation unit, wherein a surface area of said end surface of said first heat dissipation member is larger than that of said end surface of said second heat dissipation member.

17. The illumination device, as recited in claim 1, wherein said light-emitting device is a light emitting diode chip.

18. The illumination device, as recited in claim 1, wherein said light-emitting device is a light emitting diode packaging body.

19. The illumination device, as recited in claim 1, further comprising a lamp housing or an optical lens provided outside of said light-emitting device.

20. The illumination device, as recited in claim 1, wherein said active circuit connector can be an electrode lead, screw thread, bayonet or push-in spring.

* * * * *